US006887535B2

(12) United States Patent
Stroppiana

(10) Patent No.: US 6,887,535 B2
(45) Date of Patent: May 3, 2005

(54) SYNTHETIC-GRASS STRUCTURE, CORRESPONDING PARTICULATE MATERIAL, AND USE OF THE PARTICULATE MATERIAL

(75) Inventor: Fernando Stroppiana, Grinzane Cavour (IT)

(73) Assignee: Mondo S.p.A. (IT)

( * ) Notice: Subject to any disclaimer, the term of this patent is extended or adjusted under 35 U.S.C. 154(b) by 29 days.

(21) Appl. No.: 09/785,778

(22) Filed: Feb. 16, 2001

(65) Prior Publication Data

US 2001/0046589 A1 Nov. 29, 2001

(30) Foreign Application Priority Data

May 25, 2000 (IT) ..... TO2000A0476

(51) Int. Cl.[7] ..... A01N 3/00

(52) U.S. Cl. ..... 428/17; 428/95; 428/212; 428/323; 428/87

(58) Field of Search ..... 428/87, 95, 17, 428/327, 212; 47/1.01 F; 139/391, 399; 473/171, 278

(56) References Cited

U.S. PATENT DOCUMENTS

| | | | | |
|---|---|---|---|---|
| 3,731,923 A | | 5/1973 | Greene | |
| 4,337,283 A | | 6/1982 | Haas, Jr. | |
| 5,543,172 A | | 8/1996 | Jakubisin et al. | |
| 5,958,527 A | | 9/1999 | Prevost | |
| 5,961,389 A | * | 10/1999 | Dickinson | 472/92 |
| 5,976,645 A | | 11/1999 | Daluise et al. | |
| 6,242,062 B1 | * | 6/2001 | de Vries | 428/17 |
| 6,338,885 B1 | * | 1/2002 | Prevost | 428/17 |
| 6,527,889 B1 | | 3/2003 | Paschal et al. | |
| 2002/0128368 A1 | | 9/2002 | Coffey | |

FOREIGN PATENT DOCUMENTS

| | | | |
|---|---|---|---|
| DE | 202 17 142 U1 | | 3/2003 |
| EP | 0 377 925 | | 7/1990 |
| EP | 1158099 A2 | * | 11/2001 |
| JP | 10037122 | | 2/1998 |
| JP | 3253204 | | 4/2002 |
| WO | WO 01/72175 A1 | | 10/2001 |

OTHER PUBLICATIONS

European Search Report, Application No. EP 01 83 0092, 1 page.

* cited by examiner

*Primary Examiner*—Deborah Jones
*Assistant Examiner*—Abraham Bahta
(74) *Attorney, Agent, or Firm*—TraskBritt

(57) ABSTRACT

A synthetic-grass structure for laying on a subfloor comprises a sheet substrate with a plurality of filiform formations extending upwards from the substrate to simulate natural grass cover and a particulate filling material or infill dispersed between the filiform formations in such a way as to maintain the filiform formations in a substantially upright condition. The infill includes a substantially homogeneous mass of a granular material selected from polyolefin-based materials and vinyl-polymer-based materials, preferably recycled ones.

25 Claims, 1 Drawing Sheet

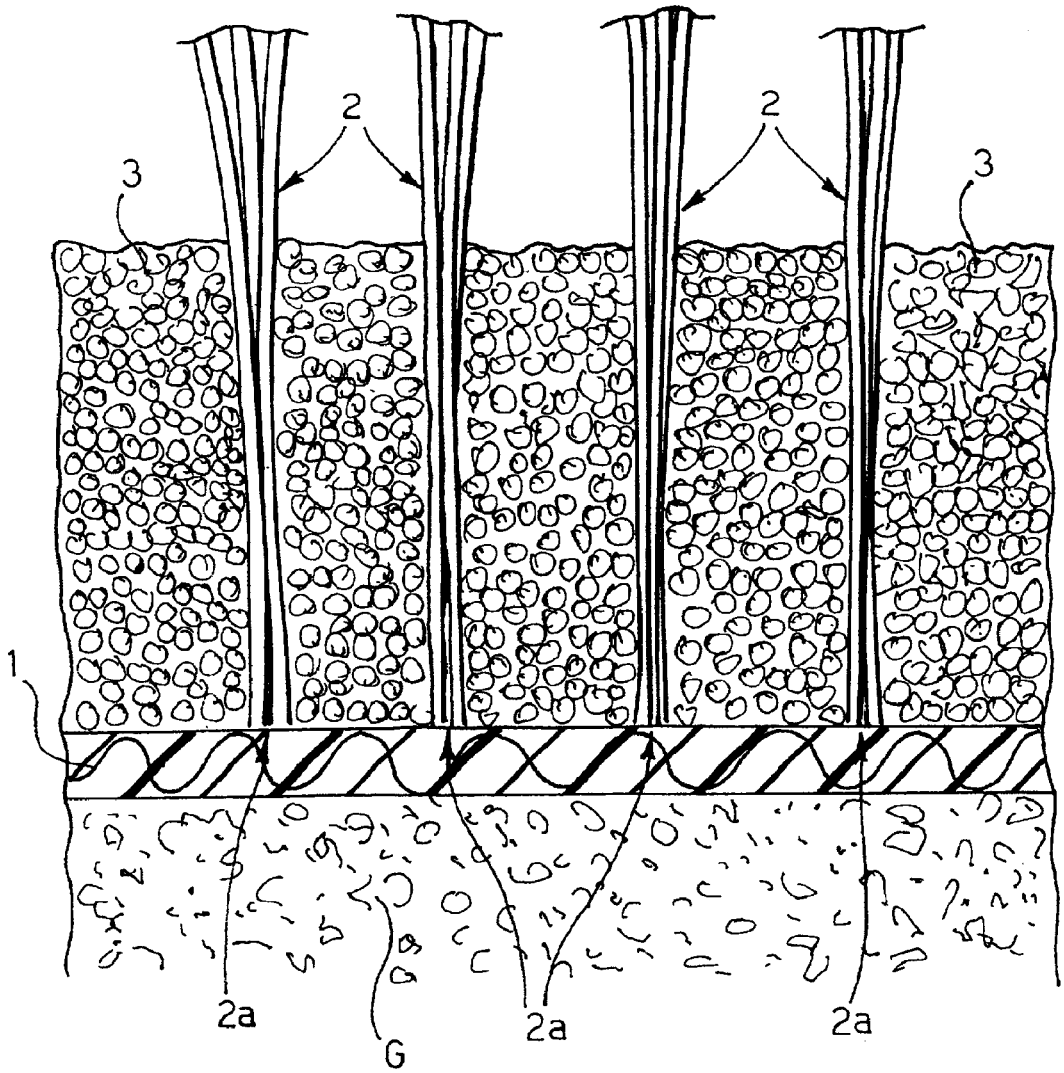
2
2
3
3
1
2a
G
2a
2a

SYNTHETIC-GRASS STRUCTURE, CORRESPONDING PARTICULATE MATERIAL, AND USE OF THE PARTICULATE MATERIAL

The present invention relates to synthetic-grass structures of the kind known, for example, from U.S. Pat. No. 5,958,527.

Basically, a synthetic-grass structure of this type comprises, in normal laying conditions, a sheet substrate with a plurality of filiform formations that extend upwards starting from the substrate itself so as to simulate natural grass cover. A particulate filling material, or infill, is dispersed between the filiform formations in such a way as to maintain the latter in a substantially upright position.

The solution described in the above-mentioned document envisages that the aforesaid infill should comprise:

a lower or bottom layer, consisting almost exclusively of a hard granular material, such as, typically, sand;

a top layer consisting almost exclusively of granules of compliant material, consisting, for example, of fragmented rubber material preferably obtained as material recycled from tires; and an intermediate layer comprising a mixture of the two particulate materials referred to above in selectively predetermined weighted ratios.

Synthetic-grass structures are often considered as being a valid alternative to natural grass above all for applications (sports facilities, etc.) in which, for different reasons (environmental conditions, intense use, etc.), upkeep of natural grass proves to be a critical problem, also as regards the maintenance costs involved.

When making and laying synthetic grass it is, however, necessary to take into account various requirements which are frequently in contrast with one another.

In the first place, it is desirable for the synthetic grass to present characteristics of tread and response to mechanical stresses (impact of various kinds, etc.) which are basically similar to the characteristics of natural grass.

The above requisite in general proves hard to meet when a sand-based filling material or infill is used.

On the other hand, recourse to sand generally proves advantageous because, precisely on account of its intrinsic weight, sand is able to provide a good effect of stabilization of the sheet substrate which constitutes the backing of the synthetic-grass cover, the said flooring usually being free laid. Furthermore, sand constitutes a filling material that is readily available at contained prices.

One of the main drawbacks linked to the use of sand is the fact that, in the case of a player or athlete falling on the synthetic covering (for example, an athlete taking part in a competition on synthetic grass), contact with the sand infill may easily give rise to scratches or bruises.

Other problems are linked to the effect of abrasion, and hence of mechanical wear, that sand invariably exerts on the filiform formations (usually made of a synthetic material, such as polypropylene, various copolymers, etc.) which simulate the blades of grass. This effect of wear may in more or less long time periods lead to breaking or tearing and consequent dispersion of the synthetic blades of grass.

Yet other problems are linked to the rate with which rain water can be removed from the synthetic flooring, given that, at least under certain conditions, the rain may collect in an undesired way in the infill of the synthetic grass.

For a more detailed treatment of the above problems and of substantially related ones, useful reference may be made to the introductory part of the document already cited.

The purpose of the present invention is to furnish a solution which enables synthetic-grass floorings to be made, overcoming the problems that may be encountered in the known art in a particularly advantageous way.

In accordance with the present invention, the above purpose is achieved thanks to a synthetic-grass structure having the characteristics specifically called for in the claims which follow.

The invention also refers, independently, to the corresponding particulate infill, as well as to the use of the latter.

The present invention will now be described, purely by way of a non-limiting example, with reference to the attached drawings, which consist of a single FIGURE that reproduces schematically an idealized vertical section of a synthetic-grass structure according to the invention.

According to a solution which is on the whole known, the aforesaid synthetic-grass structure comprises a sheet substrate 1, which is design to be laid on a subfloor G, which, in the most typical condition of use, consists of a subfloor made of tamped earth, over which the synthetic-grass cover is free laid.

The sheet substrate 1 may be made up of a sheet of plastic material, such as a non-woven fabric rubber-backed with the application, for example, of latexes, such as SBR latex.

Starting from the substrate 1, a plurality of filiform formations 2 extend upwards, the said filiform formations being usually arranged in tufts so as to resemble more closely the blades of grass of natural grass cover.

The filiform formations 2 are anchored to the substrate 1 by their proximal ends, designated by 2*a*, and extend upwards with their distal ends for a total length, measured starting from the general plane of extension of the substrate 1, which is typically in the region of 30–50 millimeters.

The general criteria for making the substrate 1 and filiform formations 2 (including the modalities for obtaining firm anchorage of the proximal ends 2*a* of the filiform formations 2 on the substrate 1) are known to the art, and hence do not require a detailed description herein also because they are of themselves not important for the purposes of understanding the invention.

Likewise known is the fact that a particulate material 3 functioning as infill is dispersed, usually during the laying of the synthetic grass on top of the substrate 1, and hence between the filiform formations 2. The function of the infill 3 is substantially that of maintaining the filiform formations 2 in an upright condition, i.e., preventing them from lying flat down in an undesired way on the substrate 1.

The particulate material 3 is usually dispersed between the filiform formations 2 in a sufficient amount for the distal portions of the filiform formations 2 to be supported by the infill 3 for a length ranging, for example, between 20 and 30 mm. This means that the distal ends of the filiform formations 2 extend out from the top surface of the layer of infill 3 for a length of about 10–20 mm.

An important feature of the solution according to the invention is provided by the characteristics of the particulate material 3. It is in fact a homogeneous material dispersed on top of the substrate 1 and between the filiform formations 2 in a substantially uniform way without giving rise to superimposed layers having different characteristics.

In the currently preferred embodiment of the invention, the aforesaid particulate material is a granular material with a grain size ranging typically between 1.5 and 4.5 mm and a density ranging typically between 1.5 and 1.6 grams/cm$^3$.

In a particularly preferred embodiment, the aforesaid material is made up of polyolefin material, such as polyethylene, and, in a yet more preferred way, of recycled polyolefin material, such as recycled polyethylene.

In another envisaged embodiment of the invention, the aforesaid material consists of a vinyl polymer, such as PVC, and, in a yet more preferred way, of recycled vinyl polymer, such as recycled PVC.

Preferably, the granules are obtained by subjecting the source material to a drawing treatment and subsequent fragmentation by means of a blade at output from the extruder/drawing machine used for the drawing process. Particularly preferred results have been obtained using drawing machines in which diameter of the die is in the region of 2.5–3.5 mm.

Preferably, the granular material has an apparent density of about 600–700 grams/liter. With a laying thickness (i.e., with a height of the layer of infill material 3 dispersed on the substrate 1) of approximately 30 mm, the total amount of dispersed infill 3 is about 15–21 kg/m$^2$, which is altogether satisfactory for the purpose of obtaining a firm retention of the synthetic grass on the subfloor G.

The fact that all the infill 3 consists of granules of material of the type described, and hence a material having a certain degree of resilience, means that any falls that may occur on the synthetic-grass cover will not give rise to undesired effects, such as bruises or scratches.

Tests carried out by the present applicant moreover show that the synthetic grass made according to the invention has, in regard to stresses caused by treading and impact, a behaviour which is basically similar to that of natural grass.

The tests conducted by the applicant have moreover revealed substantial absence of undesired phenomena of wear of the filiform formations 2 by the infill 3. The structure of the synthetic-grass cover according to the invention has moreover revealed excellent characteristics as regards disposal of rain water.

A further advantage of the solution according to the invention is provided by the fact that, should it be necessary to proceed to the removal of the synthetic-grass cover, the infill 3 can be reused and recycled completely, also on account of its altogether uniform structure.

Of course, without prejudice to the principle of the invention, the details of construction and the embodiments may vary widely with respect to what is described and illustrated herein, without thereby departing from the scope of the present invention.

What is claimed is:

1. A synthetic-grass cover structure comprising:

a sheet substrate with a plurality of filiform formations that extend from the substrate to simulate natural grass cover; and a particulate filling material or infill dispersed between said filiform formations in such a way as to maintain the latter in a substantially upright condition, wherein said particulate infill consists of a substantially homogeneous mass of a granular material chosen from the group consisting of materials comprising polyolefin and materials comprising vinyl-polymer.

2. The structure according to claim 1, wherein said particulate filling material or infill has a grain size ranging between 1.5 and 4.5 mm.

3. The structure according to claim 1, wherein said particulate infill has a density of 1.5–1.6 grams/cm$^3$.

4. The structure according to claim 1, wherein said particulate infill has an apparent density of 600–700 grams/litre.

5. The structure according to claim 1, wherein said particulate infill is dispersed for a total thickness of roughly 30 mm.

6. The structure according to claim 1, wherein said particulate infill is dispersed in a quantity ranging substantially between 15 and 21 kg/m$^2$.

7. The structure according to claim 1, wherein said particulate infill is polyethylene-based.

8. The structure according to claim 1, wherein said particulate infill has a base of recycled polyolefin material.

9. The structure according to claim 1, wherein said particulate infill is PVC-based.

10. The structure according to claim 1, wherein said particulate infill has a base of recycled vinyl polymer.

11. The structure according to claim 1, wherein said particulate infill is obtained by segmentation of a compound subjected to drawing.

12. The structure according to claim 11, wherein said compound is subjected to drawing through the die of a drawing machine having a diameter in the region of 2.5–3.5 mm.

13. A particulate filling material or infill for synthetic-grass covers, said infill being dispersible between the filiform formations simulating the grass cover in such a way as to maintain the filiform formations themselves in a substantially upright condition, wherein said particulate infill consists of a substantially homogeneous mass of a granular material chosen from the group consisting of materials comprising polyolefin and materials comprising vinyl-polymer.

14. The material according to claim 13, wherein said particulate infill has a grain size ranging between 1.5 and 4.5 mm.

15. The material according to claim 13, wherein said particulate infill has a density of 1.5–1.6 grams/cm$^3$.

16. The material according to claim 13, wherein said particulate infill has an apparent density of 600–700 grams/litre.

17. The material according to claim 13, wherein said particulate infill, when dispersed for a total thickness of roughly 30 mm, has a weight, per unit surface, ranging roughly between 15 and 21 kg/m$^2$.

18. The material according to claim 13, wherein said material is polyethylene-based.

19. The material according to claim 13 wherein said material has a base of recycled polyolefin material.

20. The material according to claim 13, wherein said material is PVC-based.

21. The material according to claim 13, wherein said material has a base of recycled vinyl polymer.

22. The material according to claim 1, made up of a compound subjected to drawing and to subsequent cutting so as to assume a particulate form.

23. The material according to claim 22, wherein said compound is subjected to drawing through the die of a drawing machine having a diameter in the region of 2.5–3.5 mm.

24. A synthetic-grass cover structure comprising:

a sheet substrate with a plurality of filiform formations that extend from the substrate to simulate natural grass cover; and a particulate filling material or infill dispersed between said filiform formations in such a way as to maintain the latter in a substantially upright condition, wherein said particulate infill consists of a substantially homogeneous mass of a granular material chosen from the group consisting of polyolefin-based materials and vinyl-polymer-based materials and wherein said particulate infill has a density of 1.5–1.6 grams/cm$^3$.

25. A synthetic-grass cover structure comprising:

a sheet substrate with a plurality of filiform formations that extend from the substrate to simulate natural grass cover; and a particulate filling material or infill dispersed between said filiform formations in such a way as to maintain the latter in a substantially upright condition, wherein said particulate infill consists of a substantially homogeneous mass of a granular material chosen from the group consisting of polyolefin-based materials and vinyl-polymer-based materials; and wherein said particulate infill is dispersed in a quantity ranging substantially between 15 and 21 kg/m$^2$.

* * * * *